United States Patent [19]

Damoisiaux et al.

[11] 4,012,101

[45] Mar. 15, 1977

[54] CIRCUIT TERMINATION DEVICE

[75] Inventors: Anthony John Damoisiaux, Basingstoke; Raymond George Evans, Kingsclere, near Newbury, both of England

[73] Assignee: ITT Industries, Inc., New York, N.Y.

[22] Filed: June 6, 1975

[21] Appl. No.: 584,277

[30] Foreign Application Priority Data

July 18, 1974 United Kingdom ..... 31845/74

[52] U.S. Cl. ..... 339/97 C

[51] Int. Cl.[2] ..... H01R 11/20

[58] Field of Search ..... 339/97–99; 174/84 C

[56] References Cited

UNITED STATES PATENTS 3,182,282 5/1965 Turner ..... 339/97 C 3,696,322 10/1972 Spangler et al. ..... 339/97 C

*Primary Examiner*—Joseph H. McGlynn

*Attorney, Agent, or Firm*—Thomas L. Peterson

[57] ABSTRACT

A termination device for terminating an electrical conductive track of a flexible circuit or a printed circuit. The device comprises a metallic member having a base with a pair of turned-over sidewalls thereon spaced apart to define an elongated gap. The base has an upwardly projecting curved portion which extends below the gap. When a circuit is positioned between the sidewalls and the base and the sidewalls are forced downwardly toward the base, the sidewalls cooperate with the curved projection on the base to tangentially grip the circuit therebetween and rupture any insulation on the circuit without piercing the conductor of the circuit.

4 Claims, 7 Drawing Figures

CIRCUIT TERMINATION DEVICE

CROSS-REFERENCE TO RELATED APPLICATIONS

The invention disclosed herein is related to and in some respects constitutes an improvement upon the invention disclosed in co-pending application of L. A. Saunders et al., Ser. No. 433,066, filed Jan. 14, 1974, entitled, "Circuit Termination Device", assigned to the assignee of the present application.

BACKGROUND OF THE INVENTION

The present invention relates to a termination device for terminating an electrical conductive track on a flexible circuit or on a printed circuit.

The present invention has special utility in the termination of conductive tracks on flexible circuits, such as flat electrical cables commonly known as strip cables, although it may be utilized for terminating conductive tracks on printed circuits as well. The invention also provides for the connection of such terminals to suitable electrical conductors, such as flat terminals or tabs.

In the aforementioned Saunders et al application, there is disclosed a termination device for a flexible circuit or printed circuit comprising a metallic member of generally rectangular form having a base and two pairs of spaced parallel sidewalls integrally formed with the base. The sidewalls of each pair are turned over or curled toward each other with the edges directed downwardly toward the base. The sidewalls are deformable so that they may be forced down by a suitable tool. One pair of the sidewalls adjacent to one end of the base is adapted to grip an electrical connection member such as a flat terminal or tab. The edges of the sidewalls of the other pair are bent outwardly slightly to provide sharp corners facing the base. Thus, when the latter sidewalls are forced downwardly toward the base, the sharp corners will pierce the insulation, if any, on a flexible or printed circuit inserted between the sidewalls and the base and will make electrical connection to the conductive track on the circuit. This arrangement has the disadvantage that on occasions the sharp corners on the sidewalls which engage the circuit will pierce the conductive track on the circuit as well as the insulation thereon, which weakens the conductive track. It is the object of the present invention to provide a termination device in which the conductive track on the circuit secured thereto will not be pierced.

SUMMARY OF THE INVENTION

According to the principal aspect of the present invention, there is provided a termination device for a flexible circuit or printed circuit comprising a metallic member of generally rectangular form having a base and a pair of spaced parallel sidewalls integrally formed with the base. The sidewalls are turned over or curled toward each other with the edges directed downwardly toward the base. The turned-over sidewalls are spaced apart from each other to define a gap therebetween. A central elongated portion of the base projects upwardly toward the gap. The elongated portion has concave surfaces which extend along the sides thereof underlying the edges of the sidewalls. The edges of the sidewalls are spaced above the elongated portion of the base a distance sufficient to allow the circuit to be inserted therebetween. The sidewalls are deformable and are shaped so that when they are forced downwardly, such as by crimping, toward the base, the sidewalls will move in a curved path generally complementary to the curvature of the concave surfaces of the elongated base to grip the circuit between the sidewalls and the base. Such movement of the sidewalls ruptures the insulation, if any, on the circuit in a scraping manner without piercing the conductive track of the circuit.

DESCRIPTION OF THE PREFERRED EMBODIMENT

Figure 1:
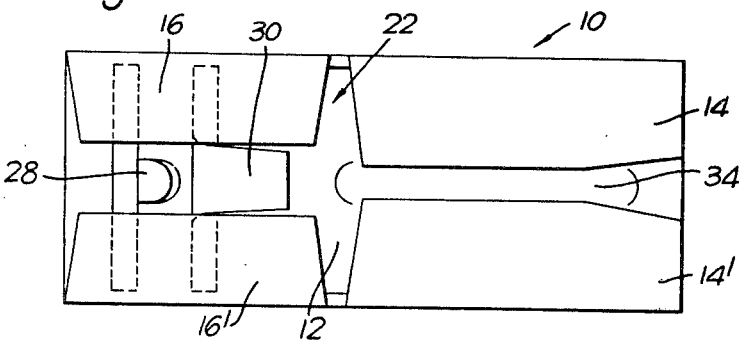
FIG. 1 is a top plan view of the termination device of the present invention.
Figure 2:
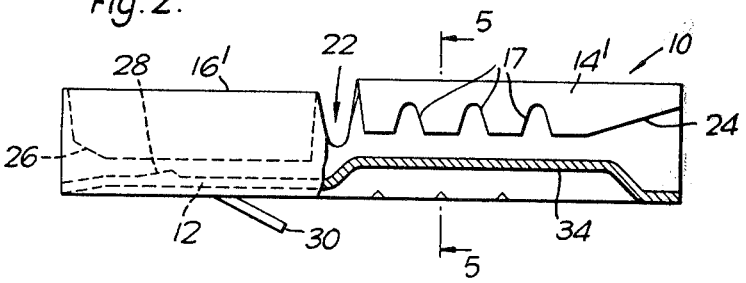
FIG. 2 is a side view, partly in section, of the device illustrated in FIG. 1.
Figure 3:
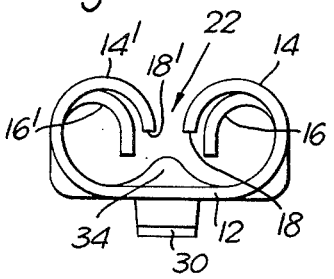
FIG. 3 is a right-hand end view of the device illustrated in FIGS. 1 and 2.
Figure 4:
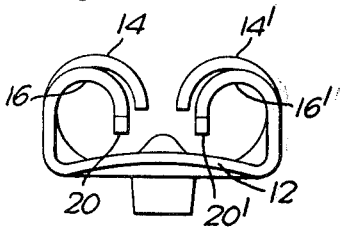
FIG. 4 is a left-hand end view of the device illustrated in FIGS. 1 and 2.

The termination device of the present invention, generally designated 10, comprises a metallic member of generally rectangular form having a generally flat base 12 and two pairs of parallel spaced sidewalls designated 14, 14' and 16, 16', respectively. The sidewalls are integrally formed with the base and extend along the longer sides of the base. The sidewalls are turned over or curled toward each other so that their edges 18, 18' and 20, 20' face the base 12. It is noted that the sidewalls 14, 14' are aligned with the sidewalls 16, 16' and are spaced apart to provide a gap 22 therebetween. The sidewalls 14, 14' are formed with cut out portions or notches 17 which open at the edges 18, 18', respectively. Only the notches in the sidewall 14 are visible in FIG. 2. The sidewalls of the device are deformable so that they may be forced downwardly toward the base by any suitable tool, such as a hand pliers, not shown.

The ends of the sidewalls adjacent to the respective ends of the base 12 are bevelled, as indicated at 24 and 26. The bevel on the sidewalls 14, 14' facilitates entry of a flexible circuit or printed circuit 28 between the sidewalls and the base 12. The bevel 26 on the opposite end of the device facilitates the insertion of a suitable connection means, not shown, usually a flat terminal or tab, which is held in the device by urging the sidewalls 16, 16' toward the base 12. An upwardly extending detent 28 on the base 12 facilitates holding the tab, and a tine 30 stamped out of the base and bent downwardly therefrom facilitates holding the termination device in an insulating support, not shown.

Figure 5:
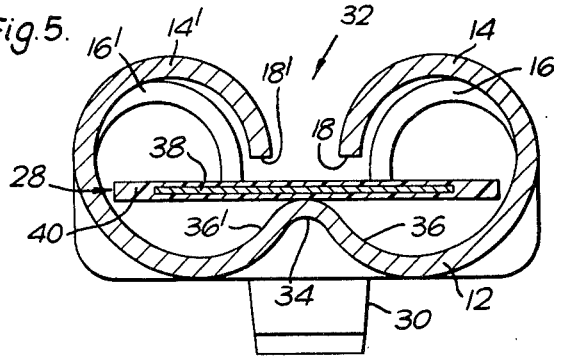
FIGS. 5, 6 and 7 are enlarged sectional views taken along line 5—5 of FIG. 2 illustrating how the termination device is secured to a flexible circuit.

The sidewalls 14, 14' are spaced apart from each other to provide an elongated gap 32 therebetween. A central elongated portion 34 of the base projects upwardly toward the gap 32. The elongated portion 34 of the base is curved at the top and is formed with concave surfaces 36, 36' which extend along the sides of the elongated member and underly the edges 18, 18', respectively, of the sidewalls 14, 14'. As best seen in FIG. 5, the edges 18, 18' are spaced above the elongated portion 34 of the base a distance sufficient to allow the circuit 28 to be inserted therebetween. The circuit comprises a conductive track 38 covered with a layer of insulation 40, as well known in the art. The circuit 28 is inserted into the termination device only up to the gap 22.

Figure 6:
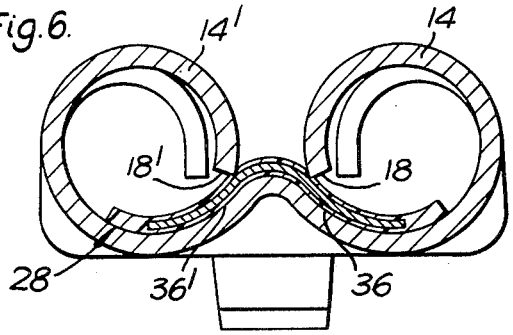
Figure 7:
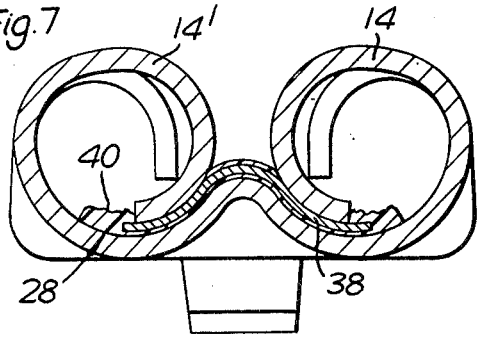

The sidewalls 14, 14' are dimensioned so that when they are forced downwardly toward the base 12, they will move in a curved path generally complementary to the curvature of the concave surfaces 36, 36'. In other words, the sidewalls tend to coil up. The spacing between the edges of the sidewalls 14, 14' and the concave surfaces 36, 36' are such that when the sidewalls are forced downwardly by crimping the device, the sidewalls will engage the upper surface of the circuit 28 and cause it to take up the configuration of the elongated portion 34 of the base as seen in FIG. 6. The distance between the edges of the sidewalls and the elongated portion 34 are such that the edges will rupture the insulation 40 on the circuit in a scraping manner but will not pierce the conductive track 38 therein, as seen in FIG. 7. Hence, a good electrical contact is obtained without piercing the track 38, which therefore is not unduly weakened. The wide area contact thus obtained produces a good mechanical retention as well as good electrical contact.

We claim:

1. A termination device for a flexible circuit or printed circuit having a conductor comprising:

a metallic member of generally rectangular form having a base and a pair of parallel, deformable sidewalls integral with said base at opposed sides thereof;

said sidewalls being turned over toward each other with their edges directed downwardly toward said base, said turned-over sidewalls being spaced from each other to define a gap therebetween;

a central elongated porition of said base projecting upwardly toward said gap, said elongated portion having concave surfaces extending along the sides thereof underlying said edges, respectively;

said edges being spaced above said elongated portion of said base a distance sufficient to allow said circuit to be inserted therebetween; and said sidewalls being shaped so that when they are forced downwardly toward said base, said sidewalls will move in a curved path generally complementary to the curvature of said concave surfaces to grip said circuit between said sidewalls and said base and to rupture the insulation, if any, on said circuit in a scraping manner without piercing the conductor of said circuit.

2. A termination device as set forth in claim 1 including:

cut-out portions in said sidewalls opening at said edges thereof.

3. A termination device as set forth in claim 1 wherein:

one end of said turned-over sidewalls are bevelled defining lead-in entranceways for said circuit.

4. A termination device as set forth in claim 1 including:

a second pair of parallel, deformable sidewalls integral with said base at said opposed sides, said second pair of sidewalls being aligned with said first-mentioned pair and spaced therefrom to define a gap therebetween; and said sidewalls of said second pair being turned over toward said base with their edges directed downwardly toward said base, and being spaced from each other, said second pair of sidewalls being adapted to grip an electrical connection member inserted between said sidewalls and said base.

* * * * *